US009033268B2

(12) United States Patent
Jacko et al.

(10) Patent No.: US 9,033,268 B2
(45) Date of Patent: May 19, 2015

(54) MATERIAL REDUCTION APPARATUS AND METHODS OF USE

(71) Applicant: Urschel Laboratories, Inc., Valparaiso, IN (US)

(72) Inventors: Michael Scot Jacko, Valparaiso, IN (US); Luc Van Buynder, Bellem (BE); Ryan Andrew Rust, Hebron, IN (US)

(73) Assignee: Urschel Laboratories, Inc., Valparaiso, IN (US)

( * ) Notice: Subject to any disclaimer, the term of this patent is extended or adjusted under 35 U.S.C. 154(b) by 119 days.

(21) Appl. No.: 14/043,426

(22) Filed: Oct. 1, 2013

(65) Prior Publication Data

US 2014/0091162 A1 Apr. 3, 2014

Related U.S. Application Data

(60) Provisional application No. 61/708,693, filed on Oct. 2, 2012.

(51) Int. Cl.

| | |
|---|---|
| ***B02C 18/14*** | (2006.01) |
| ***B02C 18/06*** | (2006.01) |
| ***B02C 18/16*** | (2006.01) |
| ***B02C 18/12*** | (2006.01) |
| ***B02C 18/24*** | (2006.01) |

(52) U.S. Cl.

CPC ..... *B02C 18/062* (2013.01); *B02C 18/16* (2013.01); *B02C 18/12* (2013.01); *B02C 18/24* (2013.01)

(58) Field of Classification Search

CPC ..... B02C 18/062; B02C 18/12; B02C 18/16

USPC ..... 241/86.1, 89.3, 242, 260

See application file for complete search history.

(56) References Cited

U.S. PATENT DOCUMENTS

| | | | | |
|---|---|---|---|---|
| 3,334,823 | A * | 8/1967 | Behnke et al. | 241/275 |
| 3,381,904 | A * | 5/1968 | Glidden | 241/73 |
| 4,128,210 | A | 12/1978 | Brenner et al. | |
| 4,470,551 | A | 9/1984 | Garland | |
| 4,610,397 | A | 9/1986 | Fischer et al. | |
| 4,657,190 | A | 4/1987 | Fischer et al. | |
| 4,660,778 | A | 4/1987 | Fischer et al. | |
| 5,201,469 | A | 4/1993 | Urschel | |

(Continued)

FOREIGN PATENT DOCUMENTS

| | | |
|---|---|---|
| KR | 10-0732000 | 6/2007 |
| KR | 2010-0040061 | 4/2010 |

*Primary Examiner* — Faye Francis

(74) *Attorney, Agent, or Firm* — Hartman Global IP Law; Gary M. Hartman; Domenica N. S. Hartman

(57) ABSTRACT

A material reduction apparatuses and methods suitable for performing cutting operations on a variety of materials, including food and nonfood products. The apparatus includes a machine having a cutting head, an impeller adapted for rotation within the cutting head about an axis thereof, means disposed on the cutting head for reducing the size of a material forced therethrough by the impeller, and an electric motor unit disposed in-line with the axis of the impeller. The electric motor unit supports the cutting head and impeller and has a shaft coupled to the impeller to rotate the impeller within the cutting head. The apparatus further includes means physically coupled to the electric motor unit for supporting the machine within a duct in which the machine is entirely enclosed. The supporting means includes arms that extend from the electric motor unit.

19 Claims, 10 Drawing Sheets

(56) References Cited

U.S. PATENT DOCUMENTS 5,694,824 A * 12/1997 Jacko et al. ..... 83/403
6,536,691 B2 * 3/2003 Prewitt et al. ..... 241/86.1
7,204,438 B2 * 4/2007 Hisamitsu ..... 241/74
2011/0240782 A1 10/2011 Sands

* cited by examiner

MATERIAL REDUCTION APPARATUS AND METHODS OF USE

CROSS REFERENCE TO RELATED APPLICATIONS

This application claims the benefit of U.S. Provisional Application No. 61/708,693, filed Oct. 2, 2012, the contents of which are incorporated herein by reference.

BACKGROUND OF THE INVENTION

The present invention generally relates to methods and equipment for reducing the size of a material.

Various types of equipment are known for slicing, dicing, shredding, granulating, comminuting, or otherwise reducing the size of materials. A widely used line of comminuting machines is commercially available from Urschel Laboratories, Inc., under the name Comitrol®, aspects of which are disclosed in patent documents including U.S. Pat. Nos. 4,660,778, 4,610,397, 4,657,190, and 5,201,469, whose contents are incorporated herein by reference. Comitrol® machines are adapted to uniformly comminute a wide variety of products at high production capacities, for example, food products including fruits, vegetables, dairy products, and meat products, as well as nonfood products including chemicals and pharmaceuticals.

A known configuration for a Comitrol® machine is depicted in an exploded view in FIG. 1. The machine is represented as comprising an impeller and cutting head assembly 10, a feed hopper 12 through which material is fed to the impeller and cutting head assembly 10, an electric motor 14 and drive belt 16 that rotates a spindle 22 on which the impeller is mounted for rotating the impeller within the cutting head, an upper enclosure 18 surrounding the assembly 10, and a lower enclosure 20 through which comminuted material drops from the assembly 10. As evident from FIG. 1, the depicted configuration is adapted to be mounted with a table that supports the motor 12. Material is delivered through the feed hopper 12 to the assembly 10 as the impeller rotates within the cutting head. The impeller includes paddles that force the material through uniformly spaced knives mounted on the cutting head parallel to the impeller axis. The spacings between the knives determined the size of the resulting comminuted product.

Various other configurations of Comitrol® machines, including their drive systems, cutting heads and impellers, are also available beyond those represented in FIG. 1. As a non-limiting example, FIG. 2 (in which the same reference numerals used in FIG. 1 are used to denote the same or functionally equivalent elements) represents the impeller and cutting head assembly 10 as comprising a larger impeller 24 and cutting head 26 than what is shown in FIG. 1. The paddles of the impeller 24 force material through uniformly spaced separators mounted on the cutting head 26 perpendicular to the axis of the impeller 24, and then through knives mounted on the cutting head 26 parallel to the impeller axis. The spacings between the separators and between the knives determine the size of the resulting comminuted product.

While configurations of the types represented in FIGS. 1 and 2 have performed extremely well for use with a wide variety of materials and applications, machines having the capabilities of the Comitrol® and adapted for additional applications and installations are desirable.

BRIEF DESCRIPTION OF THE INVENTION

The present invention provides a material reduction apparatus and method suitable for performing cutting operations on a variety of materials, including food and nonfood products.

According to a first aspect of the invention, an apparatus includes a machine comprising a cutting head, an impeller adapted for rotation within the cutting head about an axis thereof, means disposed on the cutting head for reducing the size of a material forced therethrough by the impeller, and an electric motor unit disposed in-line with the axis of the impeller. The electric motor unit supports the cutting head and impeller and has a shaft coupled to the impeller to rotate the impeller within the cutting head. The apparatus further includes means physically coupled to the electric motor unit for supporting the machine within a duct in which the machine is entirely enclosed. The supporting means comprises arms that extend from the electric motor unit, and at least one conduit is within at least one of the arms and couples the machine to the surroundings exterior of the duct.

Additional aspects of the invention include methods of using the apparatus described above to reduce the size of a material. Such methods include introducing a material into the impeller while rotating the impeller to comminute the material with the size reducing means, and causing the comminuted material to flow under the force of gravity downward and around the electric motor unit and the arms supporting the machine within the duct.

A technical effect of the invention is that the apparatus is a versatile unit that can be installed in-line in a wide variety of applications for which material comminution is desired. In particular, by locating the cutting head and impeller in-line with the motor, the apparatus can be installed in a duct allowing the apparatus to be installed within a continuous process.

The Other aspects and advantages of this invention will be better appreciated from the following detailed description.

DETAILED DESCRIPTION OF THE INVENTION

Figure 1:
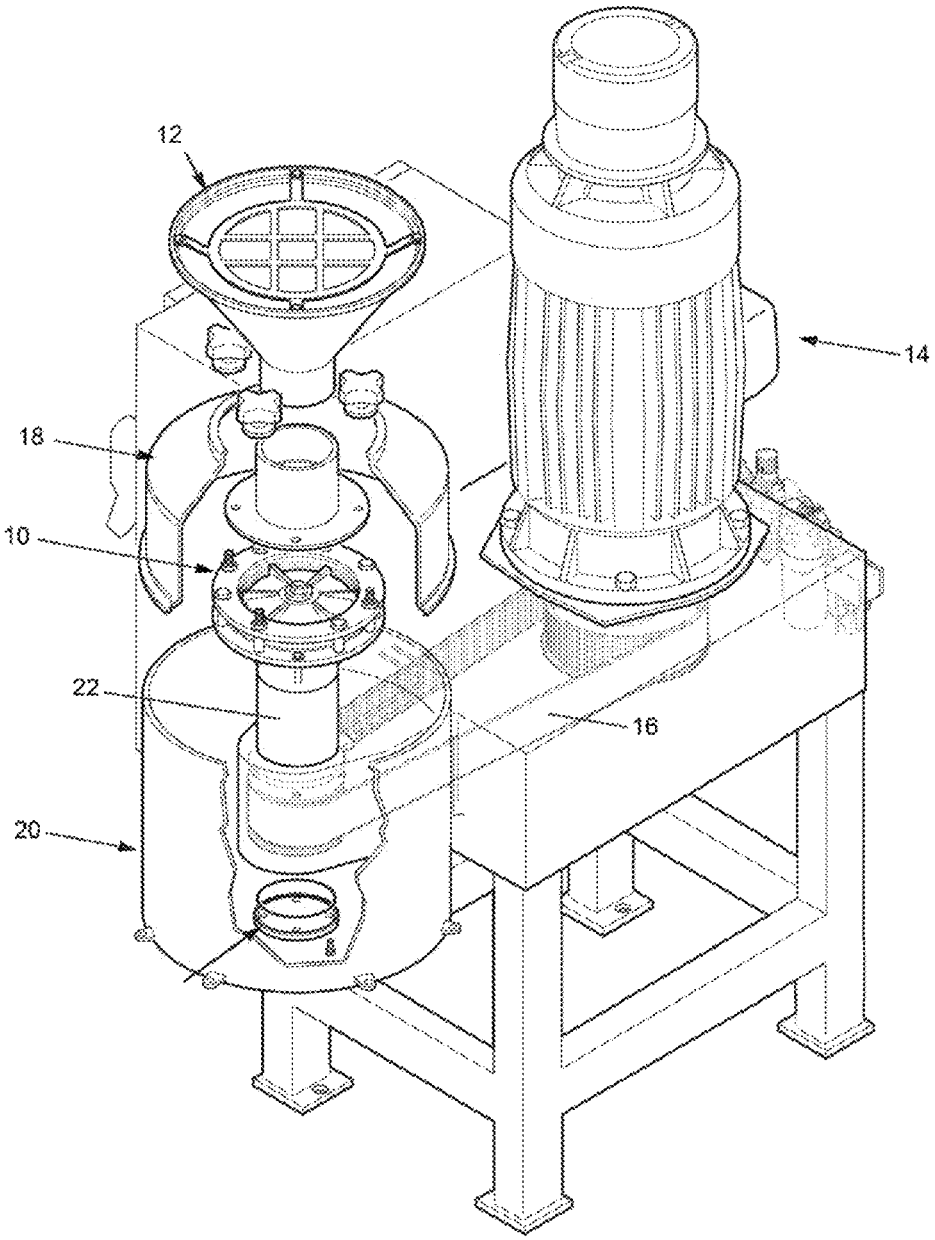
FIG. 1 (Prior Art)
FIGS. 1 and 2 represent two configurations of COMITROL® machines known in the prior art.

FIGS. 3 through 10 schematically represent various non-limiting configurations of machines within the scope of the invention. For convenience, consistent reference numbers are used throughout FIGS. 3 through 10 to identify the same or functionally equivalent elements. FIGS. 3 through 9 represent machines similar to those represented in FIGS. 1 and 2 with various modifications that allow the machines to be installed in a continuous process.

FIGS. 3 through 6 represent a machine 30 that is entirely installed within a duct 32. The duct 32 may be any enclosure, for example, a portion of a material processing system, pipe, duct, hopper, or other equipment. As such, it will be understood that the duct 32 may be any shape suitable for the intended application. The machine 30 is represented as comprising an impeller and cutting head assembly 34 that includes an impeller 36 mounted for rotation within a cutting head 38 of the impeller and cutting head assembly 34 about an axis thereof, a feed inlet 40 through which a material can be fed to the impeller and cutting head assembly 34, an electric motor 42 mounted directly beneath the impeller and cutting head assembly 34 and adapted to rotate the impeller 36 within the cutting head 38, and a lower tapered outlet 44 through which comminuted material drops from the duct 32. The motor 42 can have various performance capabilities, including a range of power levels (e.g., up to 10 HP or more), and output speeds of up to and exceeding 3000 rpm.

Figure 2:
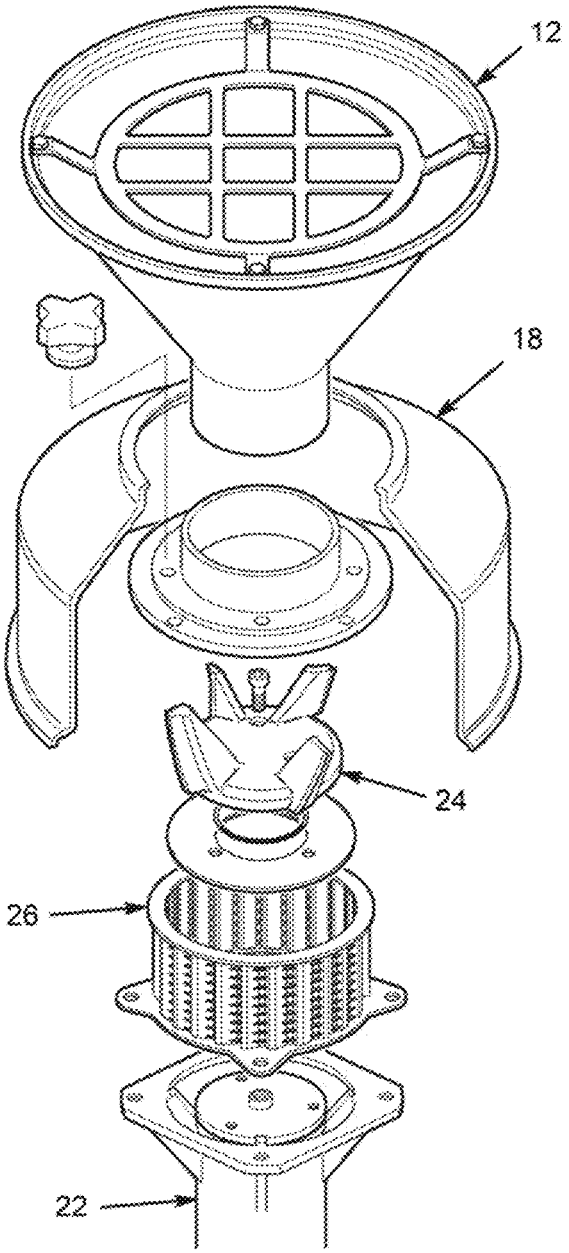
FIG. 2 (Prior Art)
Figure 3:
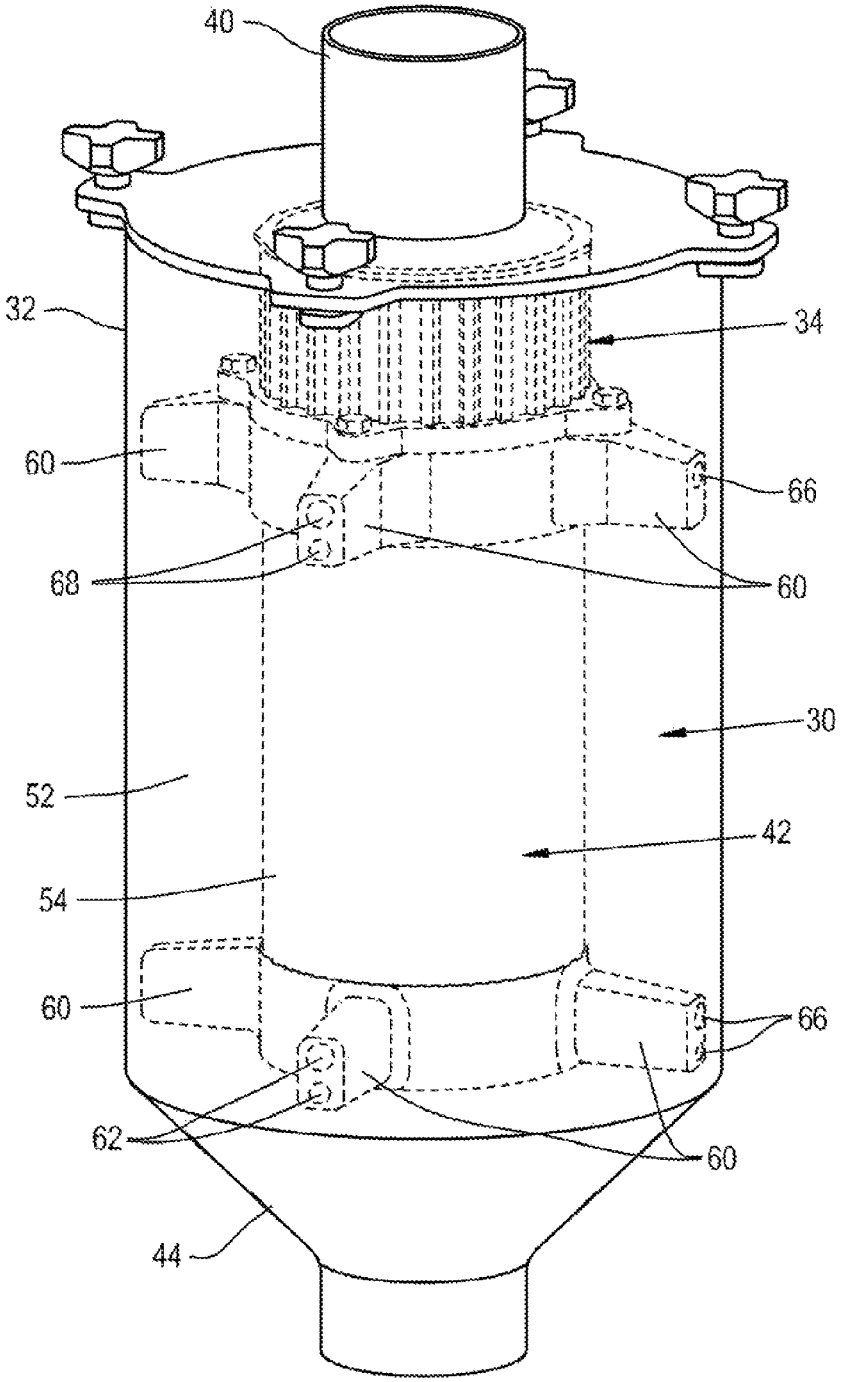
FIGS. 3 through 6 schematically represent various views of a comminuting machine adapted for installation entirely within a duct in accordance with an embodiment of this invention.
Figure 4:
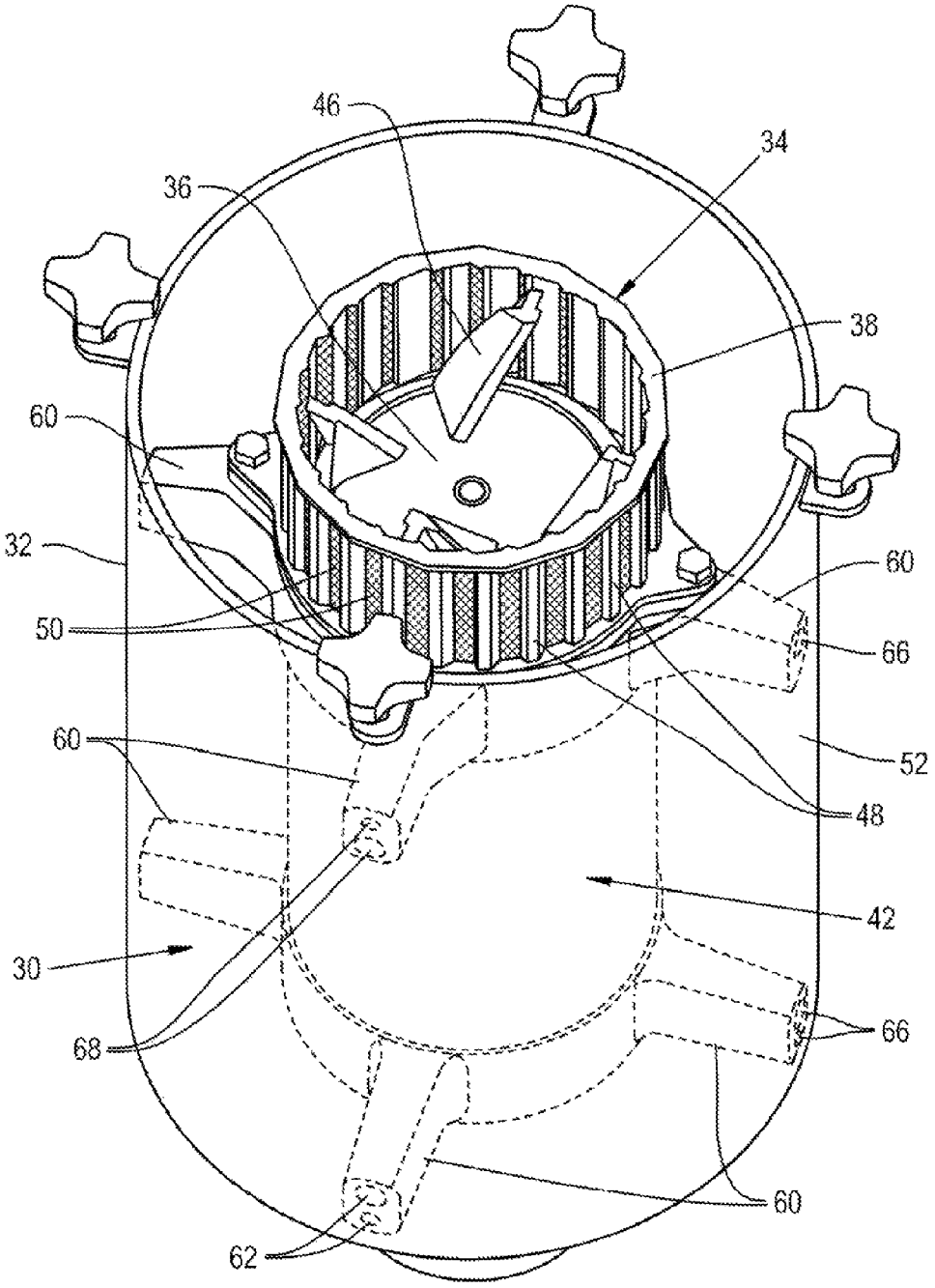

The impeller 36 and cutting head 38 are represented in FIGS. 3 through 6 as having a similar configuration to that of FIG. 2, though it should be understood that various other configurations for the impeller and cutting head assembly 34 are also possible, including but not limited to the assembly 10 represented in FIG. 1. As with the description of the machine represented in FIG. 2, FIG. 4 shows the impeller 36 as equipped with one or more paddles 46 that force material through uniformly spaced separators 48 mounted on the cutting head 38 perpendicular to the axis of the impeller 36, and then through knives 50 mounted on the cutting head 38 parallel to the impeller axis. The spacings between the separators 48 and between the knives 50 determine the size of the resulting comminuted product. As evident from FIGS. 3 and 4, material is delivered to the impeller and cutting head assembly 34 of the machine 30 through the feed inlet 40 as the impeller 36 rotates within the cutting head 38. The material may be a solid in various forms, including powders, granules, capsules and larger masses, as well as liquids, pastes, slurries, etc. The flow of the comminuted or otherwise processed material is radially outward from the cutting head 38, and thereafter into a preferably annular-shaped passage 52 defined by and between the duct 32 and an outer casing 54 of the motor 40 wherein the material proceeds downward and around or past the motor 40 and the arms 60, preferably under the force of gravity.

Figure 5:
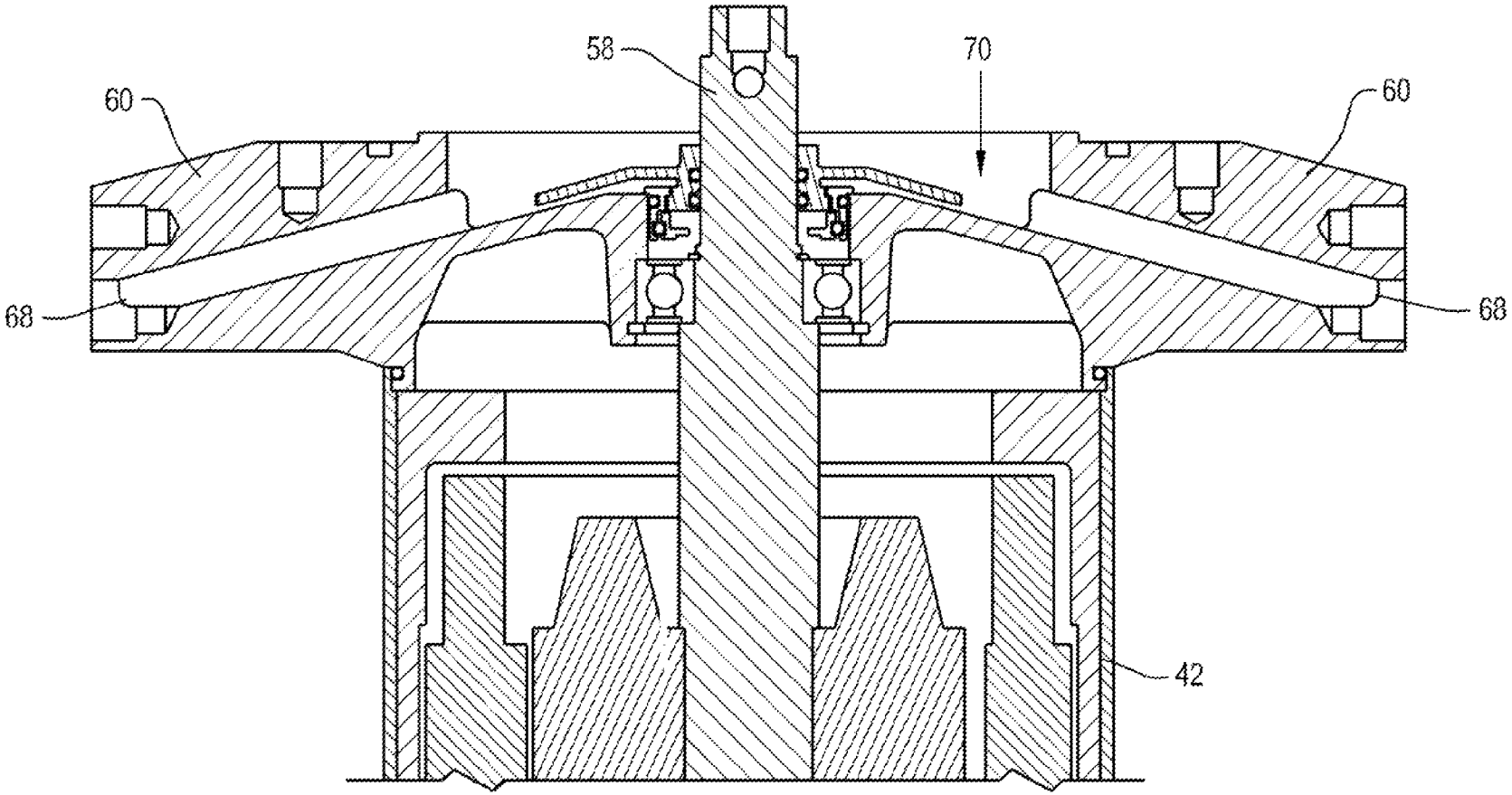
Figure 6B:
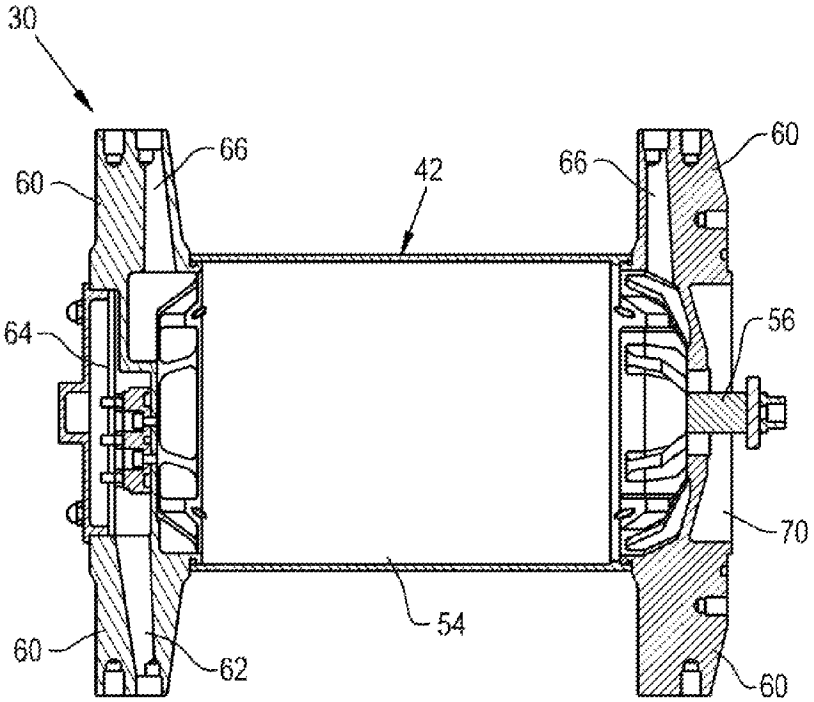
Figure 6A:
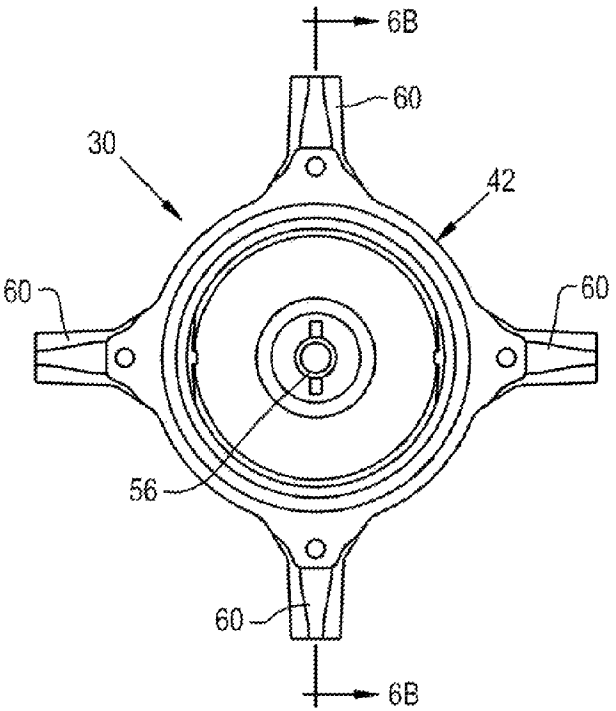
Figure 7:
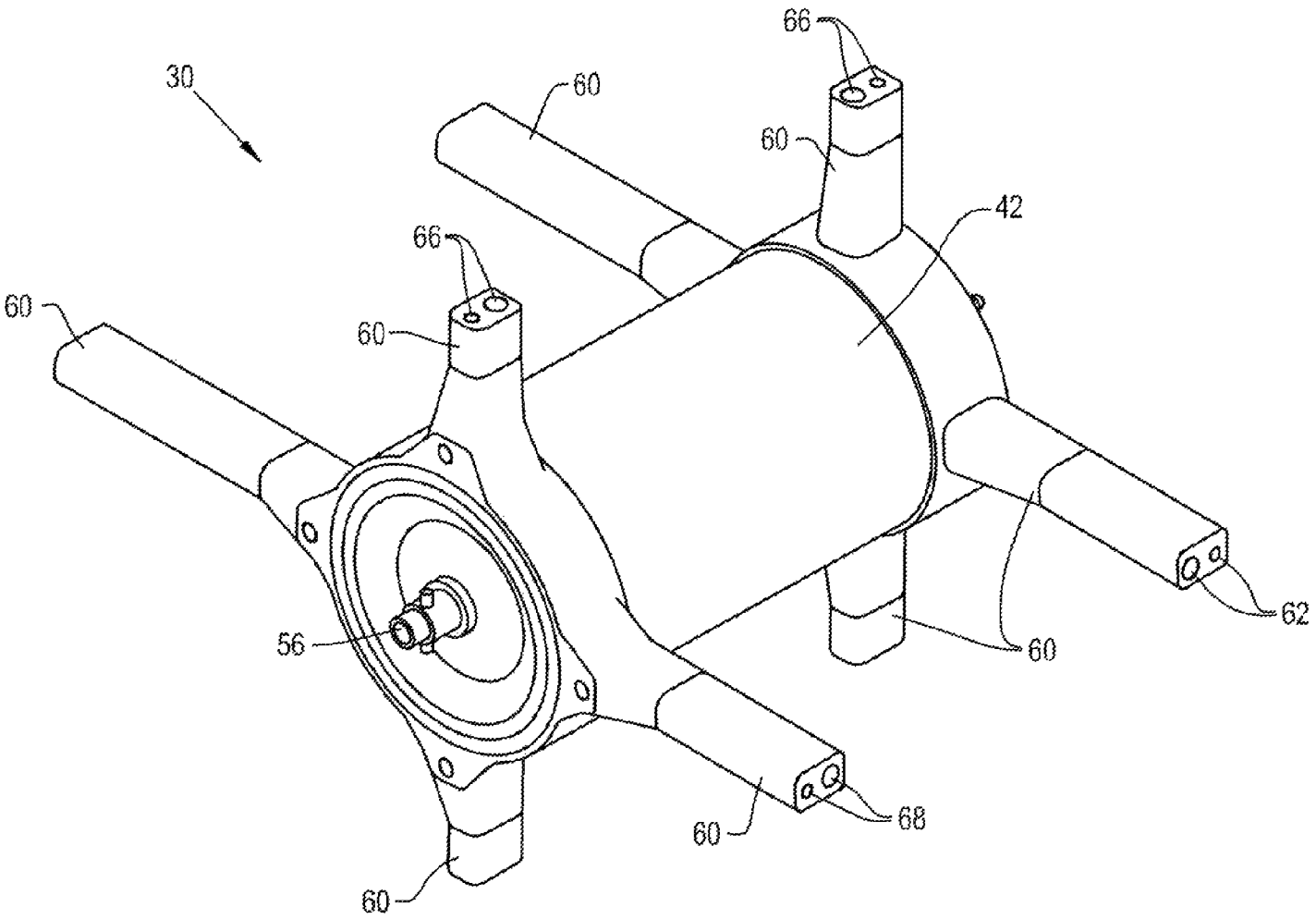
FIG. 7 schematically represents a modified configuration of the comminuting machine of FIGS. 3 through 6.

As evident from FIGS. 5 through 7, the machine 30 is directly driven by a spindle 56 coupled to an output shaft 58 of the electric motor 42. Though certain existing Comitrol® machines are also available in direct-driven versions, these machines are not configured or adapted for installation within a duct through which comminuted material flows. Instead, existing direct-driven Comitrol® machines rely on a support frame or stand and comminuted material exits through a discharge chute surrounding the cutting head. In contrast, the impeller and cutting head assembly 34 is represented in FIGS. 3 and 4 as entirely supported by the motor 42, and the machine 30 (including its motor 42) is sufficiently compact to be entirely enclosed and supported within the duct 32. The support system for the machine 30 is represented in FIGS. 3 and 4 as including sets of arms 60 that extend radially outward from the casing 54 of the motor 42 to engage the wall of the duct 32. As will be discussed below, the arms 60 can be configured and sized to have various lengths and shapes adapted for the particular duct 32 or other enclosure in which the machine 30 will be installed. Furthermore, the arms 60 constitute the only support means for the machine 30 within the duct 32 and are configured to support the machine 30 to allow cut product to flow around the arms 60 as the product passes through the duct 32. For example, the arms 60 are represented in 3-5 and 8-13 as having uppermost surfaces that are curved or multiple facets defining a generally downward curve to promote the flow of cut product around and past the arms 60.

As indicated in FIGS. 3 through 7, the arms 60 are further configured to provide passages to the exterior of the duct 32. In FIGS. 3, 4, and 6, one of four arms 60 at the lower end of the motor 42 is identified as defining a conduit 62 for routing wires (not shown) to a connector panel 64 on the lower end of the motor 42. The conduit 62 may be utilized to electrically couple the connector panel 64 to exterior equipment such as a power source and/or operation controls. Also in FIGS. 3, 4, and 6, another of the four arms 60 at the lower end of the motor 42 and one of four arms 60 at the upper end of the motor 42 are identified as defining conduits 66 for providing cooling air flow through the interior of the motor casing 54 for the purpose of cooling the stator and rotor of the motor 42. Furthermore, FIGS. 3, 4, and 5 identify at least one of the four arms 60 at the upper end of the motor 42 as defining conduits 68 fluidically connected to a cavity 70 between the impeller and cutting head assembly 34 and the upper end of the motor 42. The cavity 70 is desirable to provide a thermal barrier between the assembly 34 and motor 42, and particularly to protect the product being processed by the assembly 34 from the heat generated by the motor 42. The conduits 68 can be employed to continuously drain any product that inadvertently enters the cavity 70 from the assembly 34 above. Alternatively or in addition, the conduits 68 can be used to pressurize the cavity 70 with a gas, for example, an inert gas, to generate a dry seal that deters ingress of product and other foreign material into the cavity 70. The conduits 68 can also be used to pass a cleaning solution through the cavity 70.

Figure 8:
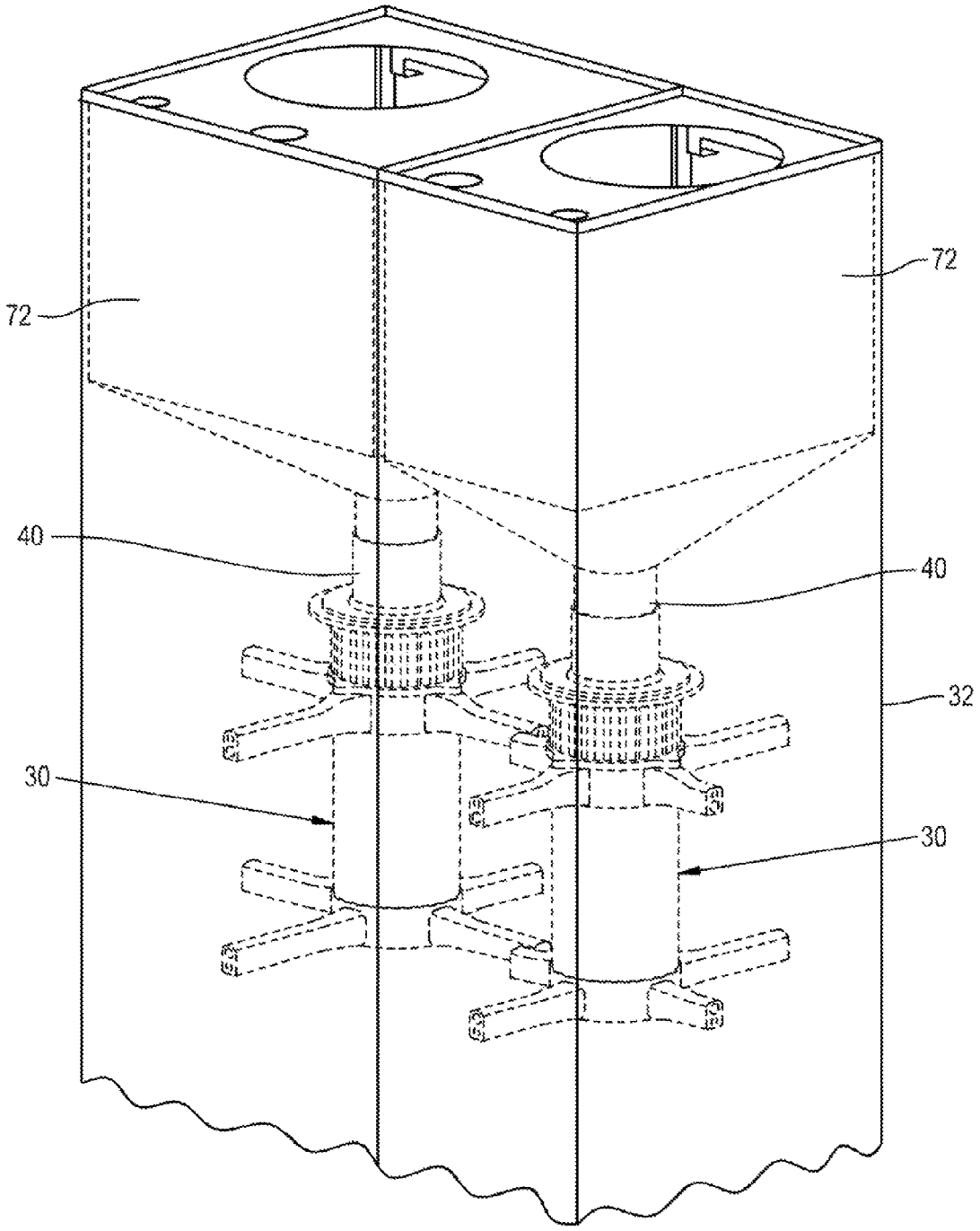
FIG. 8 schematically represents a pair of comminuting machines of types represented in FIGS. 3 through 7 and installed in side-by-side ducts.

While FIGS. 3, 4, and 6 through 9 represent the machine 30 as being equipped with two sets of four arms 60, additional sets containing fewer or more arms 60 are also foreseeable. In FIG. 7, the machine 30 is depicted as having arms 60 of different lengths being utilized. For example, FIG. 7 represents that the lengths of the arms 60 can differ within a given set, for example, adapt the machine 30 to the internal cross-section of a duct 32 and/or to position the machine 30 toward one side of a duct 32. One such configuration is represented in FIG. 8, in which two machines 30 are arranged in a side-by-side configuration with two separate ducts 32. FIG. 8 further represents the inclusion of feed hoppers 72 that are mounted on the ducts 32 and coupled to the feed inlets 40 of the machines 30.

Figure 9:
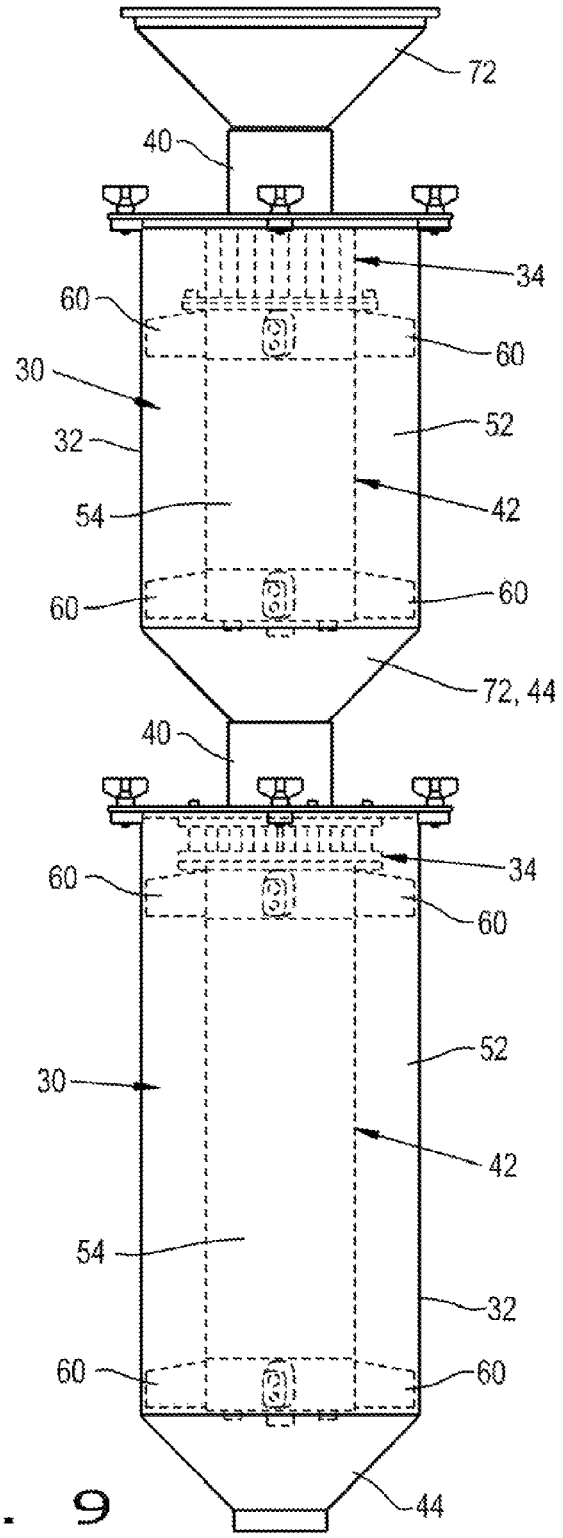
FIG. 9 schematically represents an in-line pair of comminuting machines of types represented in FIGS. 3 through 7.

FIG. 9 represents one manner in which two machines 30 can be arranged in-line with each other, such that the material processed by the upper machine 30 serves as the input material to the lower machine 30. As represented, the upper machine 30 is equipped with a larger impeller and cutting head assembly 34 similar to that shown in FIGS. 2 through 4 and 8, whereas the lower machine 30 is equipped with a smaller impeller and cutting head assembly 34 similar to that shown in FIG. 1, such that the upper machine 30 can be utilized as a precut unit and the lower machine 30 can be utilized as a finish-cut unit. Alternative in-line configurations can also be achieved with one or more of the machines 30 in combination with other and entirely different processing machines.

Figure 10:
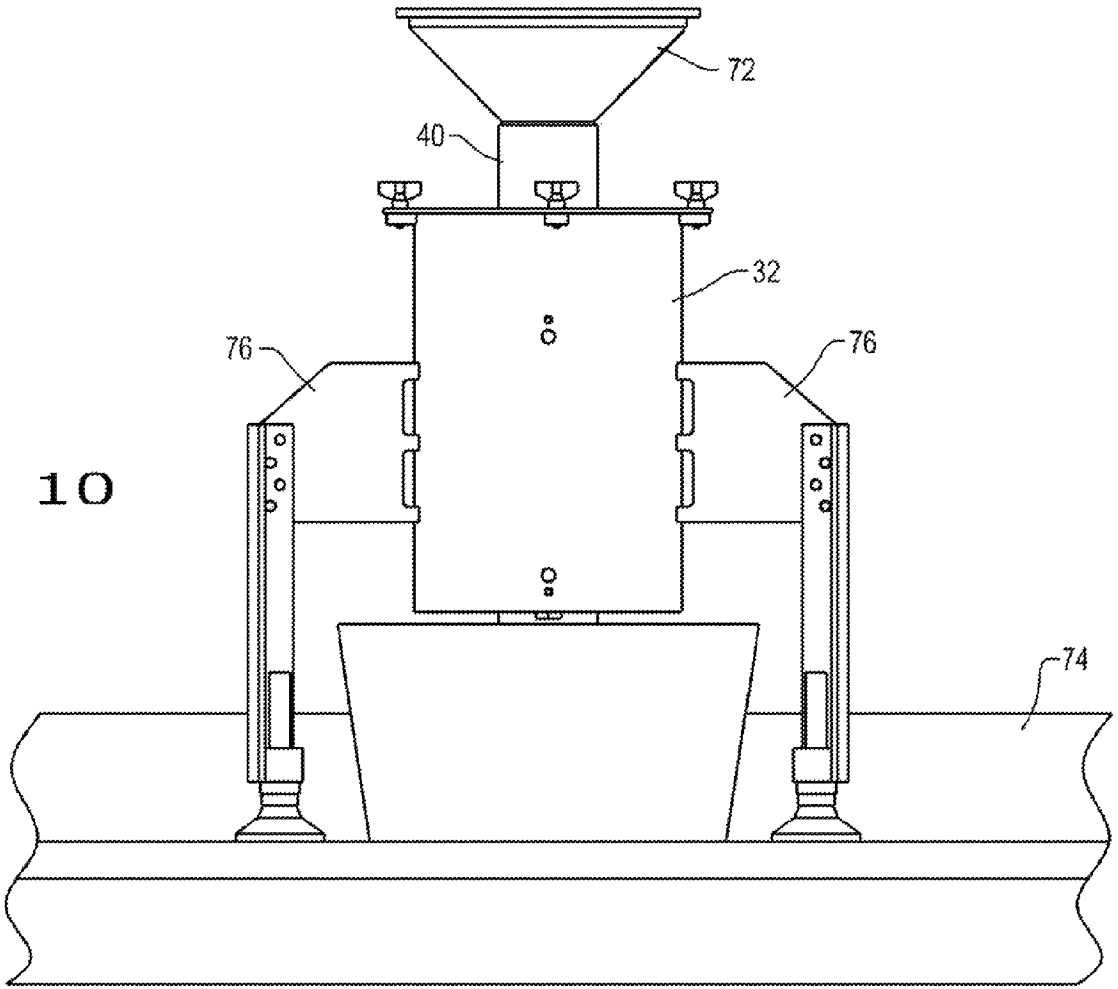
FIG. 10 schematically represents another modified configuration of the comminuting machine of FIGS. 3 through 7 and installed as a tabletop unit.

Finally, FIG. 10 represents the machine 30 as being adapted for use as a tabletop unit. For this purpose, the machine 30 is contained within the duct 32 as in previous embodiments, but the duct 32 is adapted to be supported, for example, with supports 76, on a surface of a table 74 or other suitable support structure.

A notable but nonlimiting use of a machine 30 of a type represented in FIGS. 3 through 10 or otherwise within the scope of the invention is in an application in which pharmaceuticals rejected for cosmetic reasons can be diverted offline and comminuted for disposal or reuse.

While the invention has been described in terms of specific embodiments, it is apparent that other forms could be adopted by one skilled in the art. For example, the physical configuration of the machine 30 and its components could differ from that shown, the machine 30 could be installed in ducts and other passages different from those shown, and various materials could be processed with the machine 30. Therefore, the scope of the invention is to be limited only by the following claims.

The invention claimed is:

1. A material reduction apparatus comprising a machine comprising:

a cutting head;

an impeller adapted for rotation within the cutting head about an axis thereof;

means disposed on the cutting head for reducing the size of a material forced therethrough by the impeller;

an electric motor unit disposed in-line with the axis of the impeller, the electric motor unit supporting the cutting head and impeller and having a shaft coupled to the impeller to rotate the impeller within the cutting head;

means physically coupled to the electric motor unit for supporting the machine within a duct in which the machine is entirely enclosed, the supporting means comprising arms extending from the electric motor unit; and at least one conduit within at least one of the arms and coupling the machine to surroundings exterior of the duct.

2. The material reduction apparatus according to claim 1, wherein the at least one conduit comprises cooling flow passages adapted to provide a cooling flow to the electric motor unit.

3. The material reduction apparatus according to claim 1, wherein the at least one conduit comprises a passage through which wiring of the electric motor unit is routed.

4. The material reduction apparatus according to claim 1, wherein the at least one conduit comprises a drain passage for draining a cavity between the cutting head and the electric motor unit.

5. The material reduction apparatus according to claim 1, wherein the at least one conduit comprises a passage for pressurizing a cavity between the cutting head and the electric motor unit with a gas.

6. The material reduction apparatus according to claim 1, wherein the at least one conduit is adapted to provide a cleaning solution to a cavity between the cutting head and the electric motor unit.

7. The material reduction apparatus according to claim 1, wherein the machine is a first machine of the material reduction apparatus, the material reduction apparatus further comprises a second machine, and the first and second machines are arranged coaxially in-line so that the second machine further processes the comminuted material produced by the machine.

8. The material reduction apparatus according to claim 1, further comprising the duct in which the machine is entirely enclosed and supported by the arms.

9. The material reduction apparatus according to claim 8, further comprising means for supporting the duct and the machine therein above a surface.

10. The material reduction apparatus according to claim 1, further comprising a passage defined by and between the duct and an outer casing of the electric motor adapted to direct a flow of the material from a location radially outward from the cutting head after being reduced in size, and thereafter downward past the electric motor and arms.

11. A method of reducing the size of a material using the material reduction apparatus of claim 1, the method comprising:

introducing the material into the impeller while rotating the impeller to comminute the material with the size reducing means; and causing the comminuted material to flow under the force of gravity downward and around the electric motor unit and the arms supporting the machine within the duct.

12. The method according to claim 11, further comprising providing a cooling flow to the electric motor unit through the at least one conduit.

13. The method according to claim 9, further comprising wiring of the electric motor unit routed through the at least one conduit.

14. The method according to claim 9, further comprising draining a cavity between the cutting head and the electric motor unit through the at least one conduit.

15. The method according to claim 9, further comprising pressurizing a cavity between the cutting head and the electric motor unit with a gas delivered through the at least one conduit.

16. The method according to claim 9, further comprising providing a cleaning solution to a cavity between the cutting head and the electric motor unit through the at least one conduit.

17. The method according to claim 9, wherein the material is a solid material.

18. The method according to claim 9, wherein the material is a pharmaceutical.

19. The method according to claim 9, wherein the material comprises a liquid.

* * * * *